US011228113B2

(12) United States Patent
Lv et al.

(10) Patent No.: US 11,228,113 B2
(45) Date of Patent: Jan. 18, 2022

(54) WIDE-BEAM PLANAR BACKFIRE AND BIDIRECTIONAL CIRCULARLY-POLARIZED ANTENNA

(71) Applicant: NANJING UNIVERSITY OF POSTS AND TELECOMMUNICATIONS, Nanjing (CN)

(72) Inventors: Wenjun Lv, Nanjing (CN); Yun Shao, Nanjing (CN); Leijie Wang, Nanjing (CN); Zhuang Li, Nanjing (CN); Weili Zhang, Nanjing (CN); Shanshan Gu, Nanjing (CN); Hongbo Zhu, Nanjing (CN)

(73) Assignee: Nanjing University of Posts and Telecommunications, Nanjing (CN)

( * ) Notice: Subject to any disclaimer, the term of this patent is extended or adjusted under 35 U.S.C. 154(b) by 434 days.

(21) Appl. No.: 16/471,454

(22) PCT Filed: Oct. 25, 2018

(86) PCT No.: PCT/CN2018/111790
§ 371 (c)(1),
(2) Date: Jun. 19, 2019

(87) PCT Pub. No.: WO2019/196383
PCT Pub. Date: Oct. 17, 2019

(65) Prior Publication Data

US 2021/0367349 A1 Nov. 25, 2021

(30) Foreign Application Priority Data

Apr. 11, 2018 (CN) ..... 201810319318.4

(51) Int. Cl.
*H01Q 15/22* (2006.01)
*H01Q 15/16* (2006.01)
(Continued)

(52) U.S. Cl.
CPC ..... *H01Q 15/22* (2013.01); *H01Q 1/36* (2013.01); *H01Q 9/0421* (2013.01); *H01Q 9/40* (2013.01); *H01Q 15/16* (2013.01); *H01Q 19/10* (2013.01)

(58) Field of Classification Search
CPC ..... H01Q 19/10; H01Q 9/40; H01Q 1/36; H01Q 15/14; H01Q 15/22; H01Q 9/0421; H01Q 15/16
See application file for complete search history.

(56) References Cited

U.S. PATENT DOCUMENTS 6,917,346 B2 * 7/2005 Izzat ..... H01Q 1/246 343/700 MS
8,704,728 B2 * 4/2014 Mujahed ..... G01S 3/043 343/895

OTHER PUBLICATIONS

A Novel Bidirectional Antenna With Broadband Circularly Polarized Radiation in X-Band. IEEE Antennas and Wireless Propagation Letters, vol. 13, 2014 (Year: 2014).*

(Continued)

*Primary Examiner* — Vibol Tan
(74) *Attorney, Agent, or Firm* — CBM Patent Consulting, LLC

(57) ABSTRACT

A wide-beam planar backfire and bidirectional circularly-polarized antenna. An entire planar sectorial magnetic dipole is of a semi-closed structure, the planar sectorial magnetic dipole comprises two identical sectorial patches and a vertical short-circuit wall, and the vertical short-circuit wall is connected with straight sides of the two sectorial patches along a radial direction of the planar sectorial magnetic dipole; two sets of concentric annular electric dipoles are respectively used as a top concentric annular radiating element and a bottom concentric annular radiating element, as well as a top concentric annular reflector and a bottom anti-concentric annular reflector; and the top concentric (Continued)

annular radiating element is connected with an upper surface of the planar sectorial magnetic dipole through a top connecting branch, and the bottom concentric annular radiating element is connected with a lower surface of the planar sectorial magnetic dipole through a bottom connecting branch.

10 Claims, 5 Drawing Sheets

(51) Int. Cl.

| | |
|---|---|
| ***H01Q 9/04*** | (2006.01) |
| ***H01Q 19/10*** | (2006.01) |
| ***H01Q 1/36*** | (2006.01) |
| ***H01Q 9/40*** | (2006.01) |

(56) References Cited

OTHER PUBLICATIONS

A Size-Reduced, Broadband, Bidirectional, Circularly Polarized Antenna for Potential Application in WLAN, WiMAX, 4G, and 5G Frequency Bands. Progress In Electromagnetics Research C, vol. 114, 1-11, 2021 (Year: 2021).*
Wide-beam Planar End-fire Circularly Polarized Antenna Based on SIW. 2019 IEEE (Year: 2019).*

* cited by examiner

WIDE-BEAM PLANAR BACKFIRE AND BIDIRECTIONAL CIRCULARLY-POLARIZED ANTENNA

TECHNICAL FIELD

The present invention belongs to the fields of microwave and Internet of Things, and in particular relates to a wide-beam planar backfire and bidirectional circularly-polarized antenna.

BACKGROUND

A circularly-polarized antenna can receive incoming waves from arbitrary direction, and the radiated waves can also be received by the antenna with arbitrary polarization. Therefore, the circularly-polarized antenna is widely used in electronic reconnaissance and interference, communication and radar polarization diversity operation, and electronic countermeasures. The manufacturing of the circularly-polarized antenna can be roughly implemented by three methods. The first method is to realize circular polarization by complementary dipoles; the second method is to use a rotational structure, such as a microstrip planar rotational antenna and a helical antenna with a three-dimensional structure; and the third method is to generate cross dipoles on a radiation patch or a dielectric resonant cavity, and the mode polarization of the two cross dipoles are orthogonal with a phase position. A backfire circularly-polarized antenna is a novel antenna developed on the basis of a directional antenna, which has the advantages of simple structure, convenient feeding, short longitudinal length, high gain (up to hundreds) and low sidelobe level as well as low backlobe level (up to −20 dB and −30 dB below respectively).

However, in the fields of satellite navigation, communication and radio frequency identification, the antenna is also required to have a sufficient 3 dB axial-ratio beam width (i.e., polarized beam width), and the antenna is required to have an axial-ratio beam width close to 180° (hemispherical) or even more than 180°. Although a circularly-polarized antenna with a plane rotationally symmetric structure can also realize the wide beam, the width is usually no more than 150°, and the beam is usually perpendicular to the plane of the antenna. If the circularly-polarized beam parallel to the plane of the antenna is needed, it is inevitable to introduce a non-planar structure. Therefore, how to design a (endfire, backfire or bidirectional) planar antenna with a flexible circularly-polarized beam pointing characteristic is a challenging problem. The prior art has solved the design of the planar endfire circularly-polarized antenna, but cannot realize the design of the planar backfire and bidirectional circularly-polarized antenna.

SUMMARY

Object of invention: the present invention is intended to solve the defects in the prior art, and provide a wide-beam planar backfire and bidirectional circularly-polarized antenna.

Technical solution: a wide-beam planar backfire and bidirectional circularly-polarized antenna according to the present invention comprises a planar sectorial magnetic dipole and two sets of concentric annular electric dipoles, wherein the planar sectorial magnetic dipole comprises two identical sectorial patches and a vertical short-circuit wall, the two sectorial patches are symmetrically arranged in parallel from top to bottom, the vertical short-circuit wall is connected with straight sides of the two sectorial patches along a radial direction of the planar sectorial magnetic dipole, the entire planar sectorial magnetic dipole is a semi-closed structure, and an arc end of the planar sectorial magnetic dipole is an opening; one set of concentric annular electric dipoles are used as a top concentric annular radiating element and a bottom concentric annular radiating element, and the other set of concentric annular electric dipoles are used a top concentric annular reflector and a bottom anti-concentric annular reflector; the top concentric annular radiating element is connected with an upper surface (i.e., a side of the sectorial patch on the upper surface) of the planar sectorial magnetic dipole through a top connecting branch, and the bottom concentric annular radiating element is connected with a lower surface (i.e., a side of the sectorial patch on the lower surface) of the planar sectorial magnetic dipole through a bottom connecting branch; the top concentric annular radiating element and the bottom concentric annular radiating element have the same structure and size, and are symmetrically distributed about a central axis of the planar sectorial magnetic dipole; the top concentric annular reflector and the bottom anti-concentric annular reflector have the same structure and size, and are symmetrically distributed about the central axis of the planar sectorial magnetic dipole, and a distance among the top concentric annular reflector, the bottom anti-concentric annular reflector and the planar sectorial magnetic dipole is 5 mm to 10 mm; and the sectorial patch on the upper surface of the planar sectorial magnetic dipole, the top concentric annular radiating element and the top concentric annular reflector are in the same plane, and the sectorial patch on the lower surface of the planar sectorial magnetic dipole, the bottom concentric annular radiating element and the bottom anti-concentric annular reflector are in the same plane.

Further, a range of a central angle of the planar sectorial magnetic dipole is from 90° to 360°. In order to reduce a volume of the antenna and simultaneously obtain a wider beam width, the range of the central angle of the planar sectorial magnetic dipole is from 180° to 330°.

Further, the top concentric annular radiating element and the bottom concentric annular radiating element rotate around the central axis of the planar sectorial magnetic dipole in an angle range between 90° and 160°.

Further, a range of an flared angle of the concentric annular radiating elements is from 30° to 60°; and a range of an flared angle of the concentric annular reflectors is from 45° to 135°.

Wherein, a specific installation distance between the two connecting branches and the corresponding vertical short-circuit walls is related to the range of the opening angle of the concentric annular radiating elements, that is, the larger the flared angle of the concentric annular radiating elements is, the shorter the distance between the connecting branches and end parts of the corresponding vertical short-circuit walls is.

When the range of the flared angle of the top concentric annular radiating element and the bottom concentric annular radiating element is from 30° to 45° and the range of the flared angle of the top concentric annular reflector and the bottom concentric annular reflector is from 45° to 90°, bidirectional circular polarization is realized; and when the range of the flared angle of the top concentric annular radiating element and the bottom concentric annular radiating element is from 45° to 60° and the range of the flared angle of the top concentric annular reflector and the bottom concentric annular reflector is from 90° to 135°, backfire circular polarization is realized.

Further, a height between the upper and lower sectorial patches is 4 mm to 6 mm, and a dielectric constant of a dielectric substrate filled between the two sectorial patches is 1 to 20.

Further, a feed structure is arranged on the central axis of the planar sectorial magnetic dipole, and the feed structure comprises a coaxial inner conductor and a coaxial joint outer conductor. Further, widths and lengths of the top connecting branch and the bottom connecting branch are 0.2 mm to 1.2 mm, and 0.6 mm to 3 mm respectively.

Further, widths of the two sets of concentric annular electric dipoles are all 4 mm to 8 mm.

Beneficial effect: according to the present invention, a planar structure can be used, and not only a good backfire circular polarization characteristic can be realized (an azimuth planar beam width reaches 180°, and a pitch planar beam width reaches 150°), but also a bidirectional circular polarization characteristic can be realized. The wide-beam planar backfire and bidirectional circularly-polarized antenna in the present invention is low in profile, simple in structure and large in usable bandwidth, can realize excellent circular polarization performance without adding a complicated phase shifting power division network, and has wide application prospect in various wireless sensors and various radio frequency identification systems of the Internet of Things.

DETAILED DESCRIPTION

The technical solutions of the present invention are described in detail below, but the protection scope of the present invention is not limited to the described embodiments.

Figure 1:
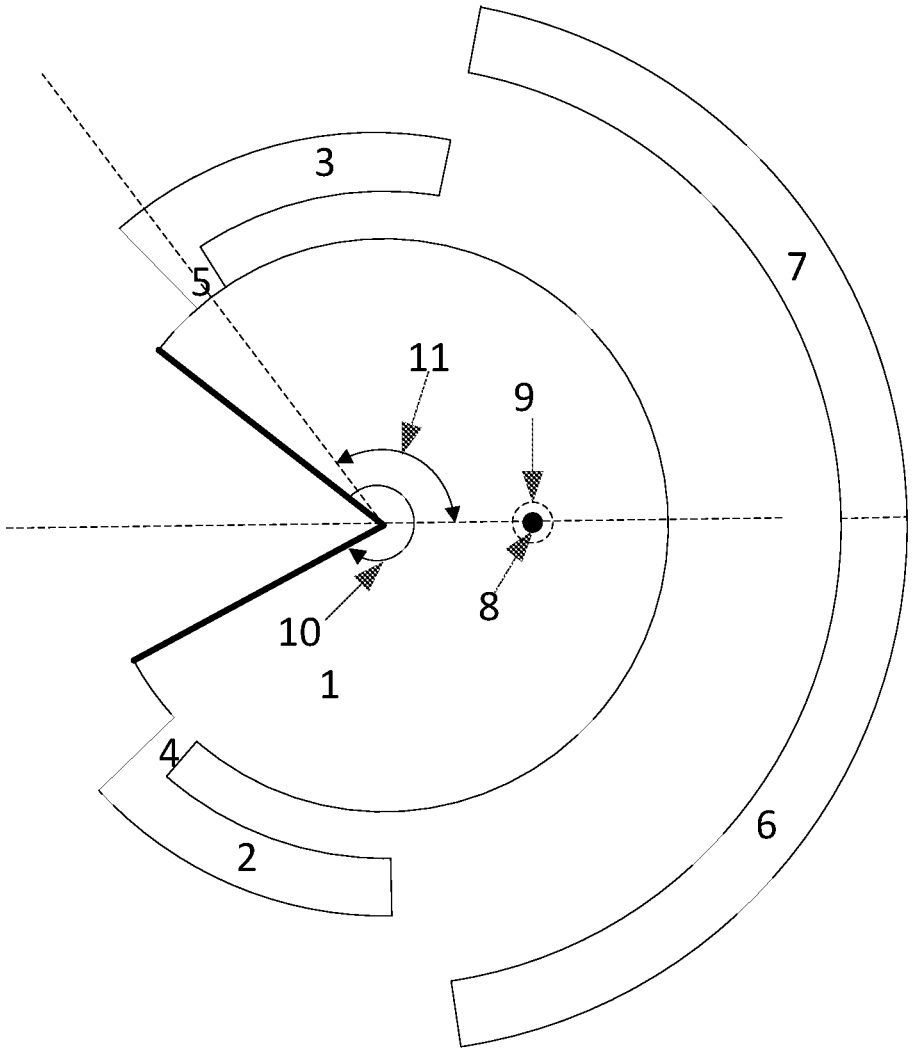
FIG. 1 is a diagram of a front structure and a reference coordinate of an antenna in the present invention.
Figure 2:
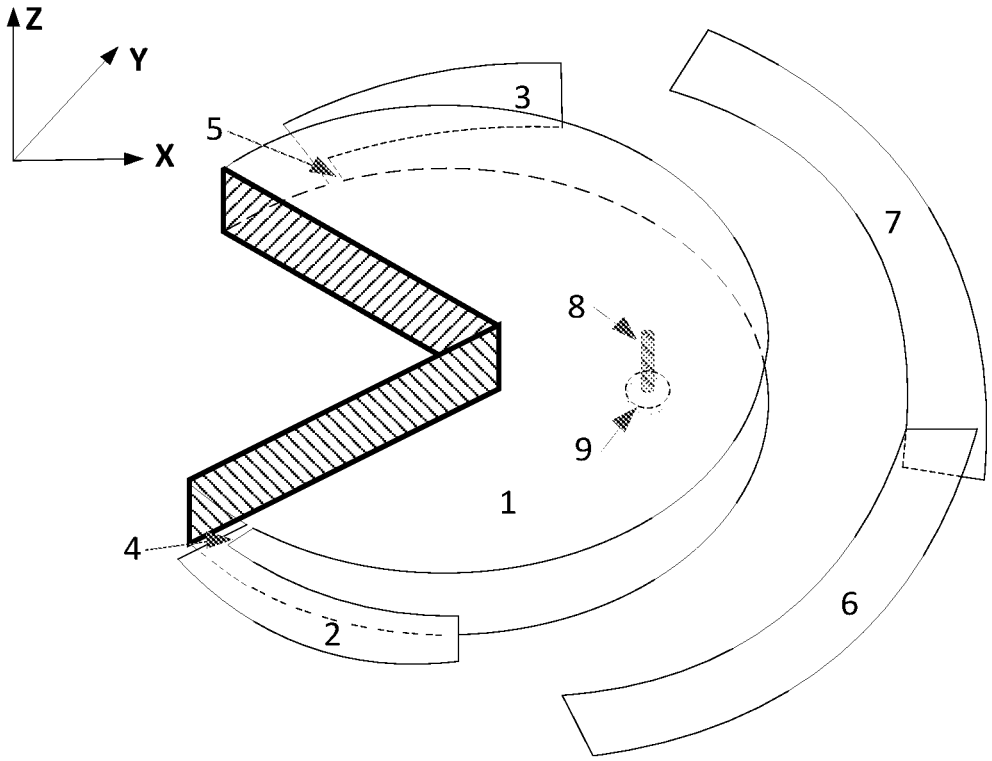
FIG. 2 is a three-dimensional diagram and a reference coordinate diagram of the antenna in the present invention.

As shown in FIG. 1 and FIG. 2, a wide-beam planar backfire and bidirectional circularly-polarized antenna according to the present invention comprises a planar sectorial magnetic dipole 1 and two sets of concentric annular electric dipoles, wherein the entire planar sectorial magnetic dipole 1 is a semi-closed structure (an opening direction is an arc end of the sectorial dipole), the planar sectorial magnetic dipole 1 comprises two identical sectorial patches and a vertical short-circuit wall, the two sectorial patches are symmetrically arranged in parallel from top to bottom, and the vertical short-circuit wall is connected with straight sides of the two sectorial patches along a radial direction of the planar sectorial magnetic dipole 1; one set of concentric annular electric dipoles are used as a top concentric annular radiating element 2 and a bottom concentric annular radiating element 3, and the other set of concentric annular electric dipoles are used a top concentric annular reflector 6 and a bottom anti-concentric annular reflector 7; the top concentric annular radiating element 2 is connected with an upper surface of the planar sectorial magnetic dipole 1 through a top connecting branch 4, and the bottom concentric annular radiating element 3 is connected with a lower surface of the planar sectorial magnetic dipole 1 through a bottom connecting branch 5; the top concentric annular radiating element 2 and the bottom concentric annular radiating element 3 have the same structure and size, and are symmetrically distributed about a central axis of the planar sectorial magnetic dipole 1; the top concentric annular reflector 6 and the bottom anti-concentric annular reflector 7 have the same structure and size, and are symmetrically distributed about the central axis of the planar sectorial magnetic dipole 1, and a distance among the top concentric annular reflector 6, the bottom anti-concentric annular reflector 7 and the planar sectorial magnetic dipole 1 is 5 mm to 10 mm; and the sectorial patch on the upper surface of the planar sectorial magnetic dipole 1, the top concentric annular radiating element 2 and the top concentric annular reflector 6 are in the same plane, and the sectorial patch on the lower surface of the planar sectorial magnetic dipole 1, the bottom concentric annular radiating element 3 and the bottom anti-concentric annular reflector 7 are in the same plane.

A range of a central angle 10 of the planar sectorial magnetic dipole 1 is from 180° to 330° to reduce an antenna volume, and meanwhile, a wider beam width can be obtained. The top concentric annular radiating element 2 and the bottom concentric annular radiating element 3 rotate around the central axis of the planar sectorial magnetic dipole 1 in a range of a rotation angle 11 between 90° and 160°. A range of an flared angle of the concentric annular radiating elements is from 30° to 60°; and a range of an flared angle of the concentric annular reflectors is from 45° to 135°. When the flared angles of the two sets of concentric annular electric dipoles are respectively from 30° to 45° and from 45° to 90°, a bidirectional circular polarization characteristic can be realized; and when the flared angles of the two sets of concentric annular electric dipoles are respectively from 45° to 60° and from 90° to 135°, a backfire circular polarization characteristic can be realized.

A feed structure is arranged on the central axis of the planar sectorial magnetic dipole 1, and the feed structure comprises a coaxial inner conductor 9 and a coaxial joint outer conductor 8. Further, widths and lengths of the top connecting branch 4 and the bottom connecting branch 5 are 0.2 mm to 1.2 mm, and 0.6 mm to 3 mm respectively. The widths of the two sets of concentric annular electric dipoles are both 4 mm to 8 mm.

EMBODIMENT

The wide-beam planar backfire and bidirectional circularly-polarized antenna in the embodiment is manufactured on a dielectric with a dielectric constant of 1 to 20, the wide-beam planar backfire and bidirectional circularly-polarized antenna comprises a planar sectorial magnetic dipole 1, a top concentric annular radiating element 2, a bottom concentric annular radiating element 3, a top connecting branch 4, a bottom connecting branch 5, a top concentric annular reflector 6 and a bottom anti-concentric annular reflector 7.

The entire planar sectorial magnetic dipole is a semi-closed structure, and is composed of two identical sectorial patches and a vertical short-circuit wall connected with straight sides of the two sectorial patches. The top concentric annular radiating element 2 and the bottom concentric annular radiating element 3 have the same structure and size, and are symmetrically distributed about a central axis of the planar sectorial magnetic dipole 1; and the top concentric annular reflector 6 and the bottom anti-concentric annular reflector 7 have the same structure and size, and are symmetrically distributed about the central axis of the semi-closed planar sectorial magnetic dipole, and a distance among the top concentric annular reflector, the bottom anti-concentric annular reflector and the planar sectorial magnetic dipole 1 is 6 mm.

An upper surface of a semi-closed end of the planar sectorial magnetic dipole 1 is connected with the top concentric annular radiating element 2 through the top connecting branch 4, and a lower surface of the semi-closed end of the planar sectorial magnetic dipole 1 is connected with the bottom concentric annular radiating element 3 through the bottom connecting branch 5. The top connecting branch 4 and the bottom connecting branch 5 have the same structure and size, and adjustable lengths and widths. The top concentric annular radiating element 2 and the bottom concentric annular radiating element 3 rotate around the central axis of the antenna by a certain angle, wherein an angle range is between 90° to 160°.

In the embodiment, a distance between an air dielectric and upper and lower surfaces of the planar sectorial magnetic dipole 1 is 6 mm, the planar sectorial magnetic dipole 1 has a radius of 26 mm and a central angle 10 of 300°, the flared angle of the top concentric annular radiating element 2 and the bottom concentric annular radiating element 3 is 50°, the top concentric annular radiating element 2 and the bottom concentric annular radiating element 3 rotate around the central axis of the antenna by an angle of 135°, lengths and widths of the top connecting branch 4 and the bottom connecting branch 5 are respectively 2 mm and 0.6 mm, the flared angle of the top concentric annular reflector 6 and the bottom anti-concentric annular reflector 7 is 75°, widths of the two sets of concentric annular electric dipoles are 6 mm, and all characteristics of the antenna are simulated and calculated by HFSS software.

Figure 3:
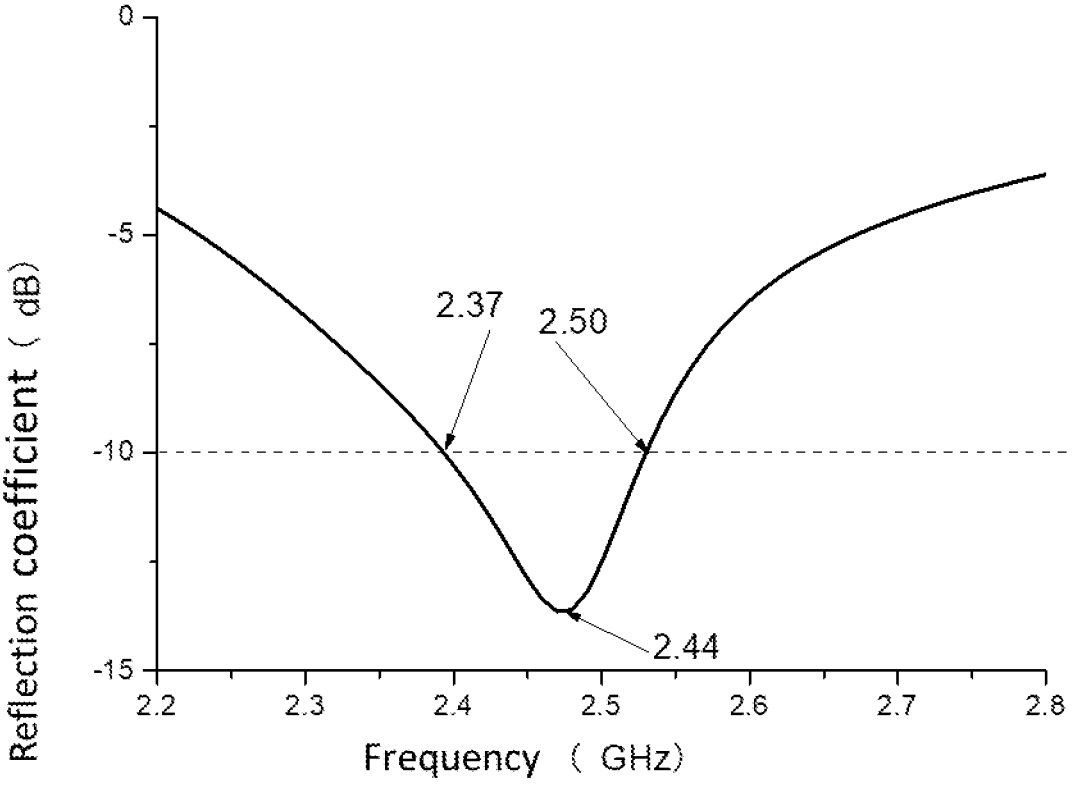
FIG. 3 illustrates an antenna reflection coefficient characteristic calculated by HFSS software in the embodiment.

FIG. 3 illustrates an antenna reflection coefficient characteristic calculated by HFSS software, and an antenna impedance bandwidth in the embodiment covers a frequency band of 2.37 GHz to 2.50 GHz, with a center frequency of 2.44 GHz, which shows that the antenna has a wider impedance bandwidth.

Figure 4:
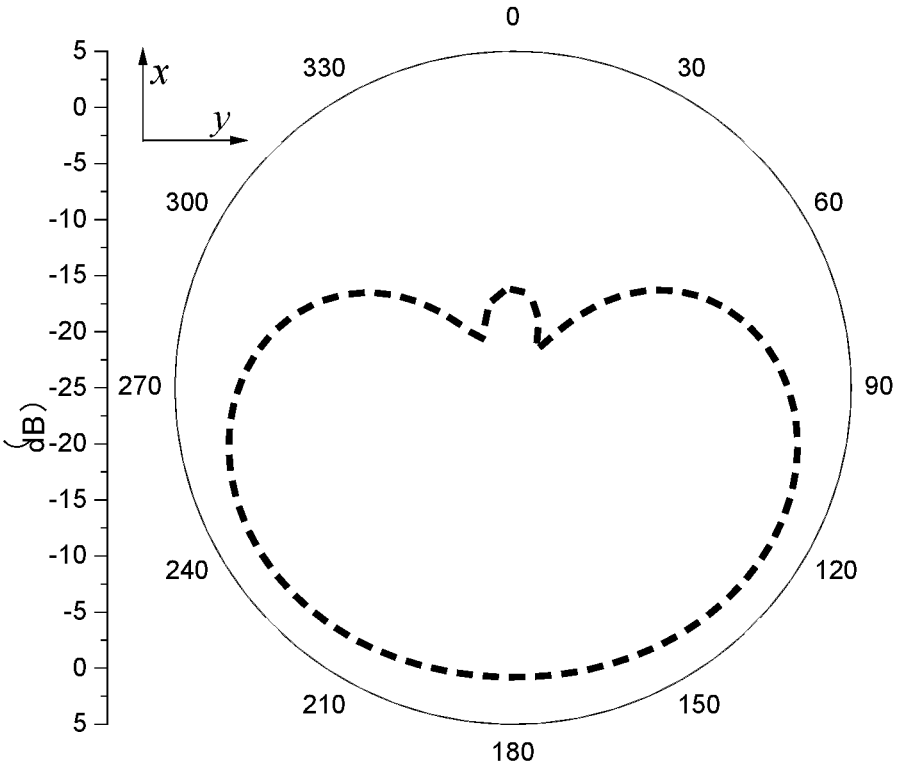
FIG. 4 is a diagram of a bidirectional radiation direction of the antenna in xy plane calculated by HFSS software in the embodiment.

FIG. 4 is a diagram of a bidirectional radiation direction of the antenna in xy plane calculated by HFSS software, the solid line indicates left-hand circular polarization and the dashed line indicates right-hand circular polarization, and it can be seen that the antenna in the embodiment has a 3 dB circularly-polarized beam width of 180°, thus having a hemispherical beam width.

Figure 5:
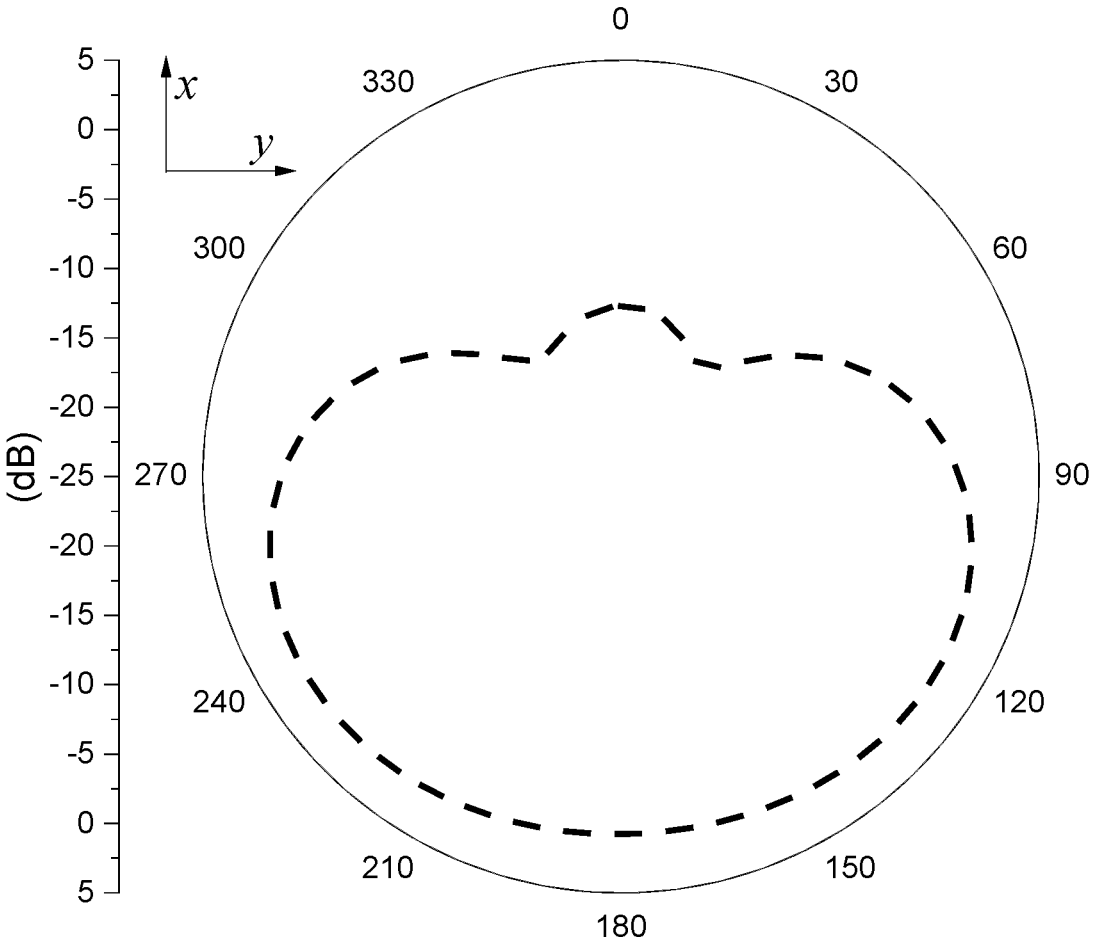
FIG. 5 is a diagram of a backfire radiation direction of the antenna in xy plane calculated by HFSS software in the embodiment.

FIG. 5 is a diagram of a backfire radiation direction of the antenna in the xy plane calculated by HFSS software, the solid line indicates left-hand circular polarization and the dashed line indicates right-hand circular polarization, and it can be seen that the antenna in the embodiment has a 3 dB circularly-polarized beam width of 165°, thus having a very wide beam width.

In conclusion, the wide-beam planar backfire and bidirectional circularly-polarized antenna of the present invention can realize a good backfire circular polarization characteristic (an azimuth planar beam width reaches 165°) and can also realize a bidirectional circular polarization characteristic.

What is claimed is:

1. A wide-beam planar backfire and bidirectional circularly-polarized antenna, comprising a planar sectorial magnetic dipole and two sets of concentric annular electric dipoles, wherein the planar sectorial magnetic dipole comprises two identical sectorial patches and a vertical short-circuit wall, the two sectorial patches are symmetrically arranged in parallel from top to bottom, the vertical short-circuit wall is connected with straight sides of the two sectorial patches along a radial direction of the planar sectorial magnetic dipole, the entire planar sectorial magnetic dipole is a semi-closed structure, and an arc end of the planar sectorial magnetic dipole is an opening; one set of concentric annular electric dipoles are used as a top concentric annular radiating element and a bottom concentric annular radiating element, and the other set of concentric annular electric dipoles are used a top concentric annular reflector and a bottom anti-concentric annular reflector; the top concentric annular radiating element is connected with an upper surface of the planar sectorial magnetic dipole through a top connecting branch, and the bottom concentric annular radiating element is connected with a lower surface of the planar sectorial magnetic dipole through a bottom connecting branch;

the top concentric annular radiating element and the bottom concentric annular radiating element have the same structure and size, and are symmetrically distributed about a central axis of the planar sectorial magnetic dipole; the top concentric annular reflector and the bottom anti-concentric annular reflector have the same structure and size, and are symmetrically distributed about the central axis of the planar sectorial magnetic dipole, and a distance among the top concentric annular reflector, the bottom anti-concentric annular reflector and the planar sectorial magnetic dipole is 5 mm to 10 mm; and the sectorial patch on the upper surface of the planar sectorial magnetic dipole, the top concentric annular radiating element and the top concentric annular reflector are in the same plane, and the sectorial patch on the lower surface of the planar sectorial magnetic dipole, the bottom concentric annular radiating element and the bottom anti-concentric annular reflector are in the same plane.

2. The wide-beam planar backfire and bidirectional circularly-polarized antenna according to claim 1, wherein a range of a central angle of the planar sectorial magnetic dipole is from 90° to 360°.

3. The wide-beam planar backfire and bidirectional circularly-polarized antenna according to claim 2, wherein the range of the central angle of the planar sectorial magnetic dipole is from 180° to 330°.

4. The wide-beam planar backfire and bidirectional circularly-polarized antenna according to claim 1, wherein the top concentric annular radiating element connected with the top connecting branch and the bottom concentric annular radiating element connected with the bottom connecting branch rotate around the central axis of the planar sectorial magnetic dipole in an angle range between 90° and 160°.

5. The wide-beam planar backfire and bidirectional circularly-polarized antenna according to claim 1, wherein a range of an flared angle of the concentric annular radiating elements is from 30° to 60°; and a range of an flared angle of the concentric annular reflectors is from 45° to 135°.

6. The wide-beam planar backfire and bidirectional circularly-polarized antenna according to claim 5, wherein when the range of the flared angle of the top concentric annular radiating element and the bottom concentric annular radiating element is from 30° to 45° and the range of the flared angle of the top concentric annular reflector and the bottom concentric annular reflector is from 45° to 90°, bidirectional circular polarization is realized; and when the range of the flared angle of the top concentric annular radiating element and the bottom concentric annular radiating element is from 45° to 60° and the range of the flared angle of the top concentric annular reflector and the bottom concentric annular reflector is from 90° to 135°, backfire circular polarization is realized.

7. The wide-beam planar backfire and bidirectional circularly-polarized antenna according to claim 1, wherein a height between the upper and lower sectorial patches is 4 mm to 6 mm, and a dielectric constant of a dielectric substrate filled between the two sectorial patches is 1 to 20.

8. The wide-beam planar backfire and bidirectional circularly-polarized antenna according to claim 1, wherein a feed structure is arranged on the central axis of the planar sectorial magnetic dipole, and the feed structure comprises a coaxial inner conductor and a coaxial joint outer conductor.

9. The wide-beam planar backfire and bidirectional circularly-polarized antenna according to claim 1, wherein widths and lengths of the top connecting branch and the bottom connecting branch are 0.2 mm to 1.2 mm, and 0.6 mm to 3 mm respectively.

10. The wide-beam planar backfire and bidirectional circularly-polarized antenna according to claim 1, wherein widths of the two sets of concentric annular electric dipoles are all 4 mm to 8 mm.

* * * * *